US005893287A

United States Patent [19]

Lyahovetsky et al.

[11] Patent Number: 5,893,287

[45] Date of Patent: Apr. 13, 1999

[54] METHOD AND DEVICE FOR COMBINED DRAWING AND HYDROSTATIC EXTRUSION OF BILLETS FROM METAL AND ALLOYS

[75] Inventors: Lev Lyahovetsky; Dmitry Genin, both of Kiryat Shmona, Israel

[73] Assignee: Project 3-P Precise Pipe Production Ltd., Kiryat Shmona, Israel

[21] Appl. No.: 08/818,745

[22] Filed: Mar. 14, 1997

[51] Int. Cl.[6] ..... B21C 31/00

[52] U.S. Cl. ..... 72/60; 72/256; 72/278

[58] Field of Search ..... 72/60, 256, 278, 72/270, 271

[56] References Cited

U.S. PATENT DOCUMENTS

| | | | |
|---|---|---|---|
| 3,747,384 | 7/1973 | Nilsson | 72/60 |
| 3,841,129 | 10/1974 | Nishihara et al. . | |
| 3,862,557 | 1/1975 | Zeitlin | 72/60 |
| 3,863,481 | 2/1975 | Dibrell | 72/60 |

FOREIGN PATENT DOCUMENTS 1726083 4/1992 U.S.S.R. .

*Primary Examiner*—David Jones
*Attorney, Agent, or Firm*—Browdy and Neimark

[57] ABSTRACT

A method and a device for forming a metal billet into an elongated product body of desired cross-sectional shape and dimension by a combination of die drawing and hydroextrusion from a pressure chamber having a central axis, holding a pressurized working liquid and being fitted with a hydroextrusion die, which are characterized by placing a drawing die of smaller cross-sectional size than the hydroextrusion die in coaxial alignment with the latter at a distance L downstream therefrom whereby the hydroextrusion die and the drawing die form a pair of dies flanking an intermediary empty region; adjusting the distance L to fit the metal and size of the elongated product body such that any stretch of an extruded body passing through the intermediary empty region retains its elastic stability; continuously extruding the billet through the hydroextrusion die to form an extruded intermediate product; continuously passing the extruded intermediate product across the intermediary empty region into the drawing die; and continuously pulling an elongated product body out of this drawing die; whereby the elongated product body is obtained with desired degrees of precision and surface quality in one operational cycle.

41 Claims, 10 Drawing Sheets

METHOD AND DEVICE FOR COMBINED DRAWING AND HYDROSTATIC EXTRUSION OF BILLETS FROM METAL AND ALLOYS

FIELD OF THE INVENTION

The present invention relates to a method and apparatus for pressure forming metal billets into profiled elongated bodies such as pipes, wire, rods and the like, applying in combination hydrostatic extrusion and drawing. The term "metal" as used herein means both an elemental metal and a metal alloy.

BACKGROUND OF THE INVENTION

About 75% of cold-formed seamless pipes, and almost 100% of pipes, rods and wires of a diameter less than 4 mm are produced throughout the world by drawing, i.e. by a relatively simple process in which a metal billet is pulled through a drawing die. The main disadvantage of this process is that it has to be carried out in several stages or cycles, notably in the production of small-diameter pipes and rods where the required sizing of the final product is achieved only after a considerable number of stages. The need for a multi-stage operation stems from the known fact that in a single drawing stage, the deformation expressed by the ratio of a cross-section area of an elongated body before and after drawing cannot exceed about 55%. Accordingly, for the production of, for example, seamless capillary steel pipes, as many as about 10 to about 20 drawing stages may be required. Such a multi-stage process requires a variety of intermittent auxiliary operations such as thermal treatment, etching, straightening, cutting, etc. all of which impair the degree of precision with which the final body is formed as well as the surface quality thereof. In addition, the multi-stage nature of the process in combination with the auxiliary operations augments the volume of the required industrial facilities and leads to increased consumption of metal, energy and working time. Also, at least some of the auxiliary operations are ecologically hazardous. Finally, the drawing process for the formation of elongated bodies is inadequate for the manufacture of a variety of specific products such as, for example, pipes and rods from brittle or super-hard metals, thick walled pipes with a relatively small and precise inner channel, high precision pipes and others.

In the production of metal pipes and rods, the above shortcomings may be at least partly overcome by employing so-called hydrostatic extrusion, also known as hydroextrusion. Hydroextrusion is a process in which a billet is squeezed through a die mounted in a wall of a pressure chamber filled with a pressurized working liquid serving for the creation of a working pressure that exceeds the yield point of the processed metal. As known to those skilled in the art, by this technique, it is possible to achieve in one single stage a deformation that exceeds 55%. However, this process in which the driving force for the extrusion is provided exclusively by the pressurized working liquid, is slow, non-stable and expensive and accordingly not widely used.

In an effort to improve the productivity of hydroextrusion, it has been proposed to combine the drawing and hydroextrusion techniques into one processing cycle for the continuous production of wire, rods and pipes.

U.S. Pat. No. 3,747,384 describes a method of reducing the cross-sectional area of a body by means of hydroextrusion with the simultaneous application of a pulling force. In accordance with that method extrusion, which proceeds via a conical extrusion die, proceeds by the action of two driving forces, to wit hydrostatic pressure and pulling force, which act in combination on the billet passing through one and the same die. The deformation of the billet achieved in this way does, however, not correspond to the maximal sum of deformations which might be provided separately by hydroextrusion at the given pressure and drawing at the given pulling force, because, for the optimization of these two forces, different conical shapes of the die are required.

U.S. Pat. No. 3,841,129 describes a continuous hydrostatic extrusion process and apparatus wherein in a first phase a stock wire is drawn through a drawing die into a high pressure chamber with a hydroextrusion die and is spooled therein, and in a second phase the partly formed wire which remains under hydrostatic pressure is paid off and drawn through the hydroextrusion die. A single apparatus unit thus performs a first forming operation by drawing and a second, subsequent forming operation by hydrostatic extrusion, and by using a series of two or more such units, the forming operation may be performed in several stages. Basically, the second forming operation of U.S. Pat. No. 3,841,129 is equivalent to the process of U.S. Pat. No. 3,747,384.

SU 1,726,083 A1 describes a method and equipment for the continuous forming of elongated tubular billets into pipes applying in combination hydroextrusion and drawing. The equipment includes a high pressure chamber with inlet port for a tubular billet and with a hydroextrusion die, and pulling means for applying pulling force to the forward end of the billet protruding from the hydroextrusion die, and basically this method is similar to that of U.S. Pat. No. 3,747,384.

The above specified methods and equipment are typical of the prior art and as mentioned have an intrinsic shortcoming that in one operational cycle the deformation does not yield the maximal possible deformation at the given energy consumption. In addition, these methods are inadequate for the production of thin-walled pipes since the elevated liquid pressure inside a pipe would tear it at the exit from the hydroextrusion die where the pressure around the pipe drops down to atmospheric. Still further, in the prior art equipment, the operations cannot be adjusted to the requirements of specific materials such as hard and brittle metals and to other needs of a specific case. Still further, the known combined methods are inadequate for the production of pipes and other elongated products with a high degree of precision and good surface quality.

A further problem encountered in hydroextrusion is the so-called shot effect which occurs when the rear end of a pressure formed elongated body is forced away from the hydroextrusion die by the action of the pressurized liquid inside the pressure chamber. It has been proposed to avoid the shot effect by providing the billet with a flaring rear end portion which is retained by the hydroextrusion die at the end of the extrusion operation, i.e. when the billet would otherwise be ejected from the high pressure chamber. By another known method for avoiding the shot effect, the pressure within the pressure chamber is abruptly reduced when the rear end of the billet reaches the hydroextrusion die. By either of these methods the shot effect may be eliminated but they have the common drawback that at the end of a cycle, the hydroextrusion die must be dismantled for removing therefrom the stuck end of the billet, which is an obvious complication that affects the efficiency of the operation and leads to a loss of metal.

OBJECTS OF THE INVENTION

It is an object of the present invention to provide a new method for forming billets into pipes, thin rods and wire by a combination of hydroextrusion and die drawing, suitable also for the use of hard metal and brittle billets and designed to provide in one single operational cycle the maximal billet deformation (at a given expenditure of energy on providing the hydroextrusion and the drawing), for example the deformation as high as 90% and more.

It is a further object of the invention to provide a method of the kind specified designed to eliminate the shot effect.

It is yet a further object of the invention to provide an apparatus for the performance of such methods.

GENERAL DESCRIPTION OF THE INVENTION

In the following description and claims, the terms "upstream" and "downstream" will be used in relation to the performance and design of a combined hydroextrusion and die drawing operation to describe the mutual positions of operational steps and apparatus components relative to the direction at which a billet moves across the apparatus. Thus for example, between two coaxial dies in an apparatus according to the invention, the one proximal to the feeding end of the pressure chamber is the upstream die and the one distal from that end is the downstream die.

It has been found in accordance with the present invention that the shortcomings of the prior art arise out of the fact that a combination of hydrostatic extrusion and die drawing in one single die is ineffective, since it cannot be optimized. It has further been found that the fact that such prior art combined operations do not yield the high deformation which might have been expected in principle, is due mainly to the inability to adjust the operations to the specific requirements of a given case. Still further, it has been realized in accordance with the invention that all the known combined operations of hydroextrusion and die drawing aim only at accelerating the hydroextrusion by adding a pulling force and they do not provide a combined hydroextrusion and drawing operation with separate dies.

In accordance with the invention there is provided a method of forming a metal billet into an elongated product body of desired cross-sectional shape and dimension by a combination of die drawing and hydroextrusion from a pressure chamber having a central axis, holding a pressurized working liquid and being fitted with at least a terminal hydroextrusion die, characterized by placing at least one drawing die of smaller cross-sectional size than said terminal hydroextrusion die in coaxial alignment with the latter at a distance L downstream therefrom whereby said terminal hydroextrusion die and at least one drawing die flank an intermediary empty region;

adjusting said distance L to fit the metal and size of the elongated product body such that any stretch of an extruded body passing through the intermediary empty region retains its elastic stability;

continuously extruding the billet through said terminal hydroextrusion die to form an extruded intermediate product;

continuously passing said extruded intermediate product across said intermediary empty region into said at least one drawing die; and continuously pulling an elongated product body out of said at least one drawing die;

whereby said elongated product body is obtained with desired degrees of precision and surface quality in one operational cycle.

In operation, a stretch of the extruded body is held at all times by the drawing die flanking the said intermediary empty region whereby the shot effect is avoided even when the rear (upstream) end portion of the extruded intermediate product emerges from the terminal hydroextrusion die.

If desired, the said intermediary empty space may be in form of an expansion chamber designed to collect any working fluid forced out of the terminal hydroextrusion die at the end of an operational cycle, means being preferably provided for recycling the collected working fluid to the pressure chamber.

The stipulation that while in the intermediary empty region the extruded intermediate product retains its elastic stability, means that the yield point of the body portion passing through that region is not exceeded and the body under formation is thus not torn, crumpled or bent and retains its lateral and longitudinal stability.

The method according to the invention enables, to say the least, to sum in one operational cycle the complete deformation effects provided separately by each of the hydroextrusion and die drawing operations and thereby to increase the deformation of the billet.

In accordance with the invention, the hydroextrusion operation is performed either by one single hydroextrusion die which in this case is the terminal one, or by a series of coaxially aligned hydroextrusion dies located in a wall of the hydroextrusion chamber and having gradually diminishing bearing cross-sectional dimensions in which series said terminal hydroextrusion die is the one distal from the pressure chamber. Likewise, the drawing operation may involve the use of one single drawing die or a coaxially aligned row of drawing dies with gradually diminishing bearing cross-sectional areas, in which case the first (upstream) die in the row flanks the intermediary empty region. The term "bearing cross-sectional area" is accepted in the art for defining the cross-sectional dimension of the inner working (bearing) channel of the extrusion or drawing die.

In accordance with the invention, the distance between the hydroextrusion and drawing dies flanking the intermediary empty region is optimized with due regard to the properties of the metal of which the billet is made, cross-dimension of a so-called extruded intermediate product leaving the hydroextrusion die, and parameters of the process. As a rule, this distance is from about 2 to about 6 D where D is a cross-dimension of the delivery opening of the hydroextrusion die flanking the intermediary empty region, e.g. the diameter in case of an annular or circular delivery opening. The cross-dimension D is substantially close to the cross-dimension of the extruded intermediate product. The precise distance L may be determined on the basis of available empirical data, and where required, by simple preliminary experimentation.

For example, for thick-walled pipes in which the ratio between the outer diameter and the walled thickness is less than 5, the distance L is essentially not less than 6 D. For thin-walled pipes in which the ratio between the outer diameter and the walled thickness is more than 5, the minimum distance L is about 2 D, as well as for wires and rods.

The performance of the method according to the invention depends among others on the hydrostatic pressure inside the pressure chamber, the pulling force and the velocity at which the product is pulled out of the drawing die or the last drawing die in a row, as the case may be, and a suitable combination of these parameters is selected in advance.

The significant increase of the degree of billet deformation achieved in accordance with the present invention may be explained as follows. The hydroextrusion die or dies, as the case may be, constitutes or constitute a first zone of deformation. In that zone the deformation of the billet is mainly due to the compression of the metal by the hydrostatic pressure inside the pressure chamber and the compressed billet is driven through the hydroextrusion die mainly by the hydrostatic pressure but to a certain extent also by a residual pulling force reaching the upstream side the drawing die that flanks the intermediary empty region, which acts on the extruded intermediate product. The drawing die or dies, as the case may be, constitutes or constitute a second zone of deformation. When the extruded intermediary product enters this zone, the deformation is due mainly to the external pulling force augmented by some residual hydrostatic pressure propagating from the downstream side of the terminal hydroextrusion die. Depending on the selected balance between the pulling force and hydrostatic pressure in the pressure chamber, one may create in the intermediate product moving between the terminal hydroextrusion die and the first drawing die either a slight compression stress, or a slight tensile stress being directed axially. Accordingly, in both the first and second zones of deformation and also in the intermediary empty region, the body under formation may be subjected to a desired state of stress so as to maximize the deformation. Moreover, the hydrostatic pressure and the pulling force may be adjusted during the processing cycle. Thus, in accordance with the invention it is possible to fully exploit the advantages of each of the hydroextrusion and die drawing operations, i.e. to create the most advantageous state of stress in the extruded intermediate product passing through the intermediary empty region, and thereby to obtain a desired degree of deformation in one single processing cycle.

By one mode of operation particularly suitable for the high deformation of billets made of hard and brittle metals, the extruded intermediate product moving across the intermediary empty region is maintained under a compression stress in the axial direction. In this way the extruded body passing across the intermediary empty region arrives at the flanking drawing die in a slightly compressed state, which improves the deformation during drawing of even a hard and brittle metal. In this mode of operation the additional force due to compression does, as a rule, not exceed 0.4 of the pulling force.

By an alternative mode of operation suitable for forming billets of soft metals, the axial tensile stress is created in the extruded intermediate product passing through the intermediary empty region whereby the degree of deformation is significantly improved.

The process may be carried out with continuously maintaining a selected stress state regime in the extruded intermediate product, for example by continuously measuring the velocity at which the elongated product body is pulled out of the downstream drawing die, and by continuously adjusting said hydrostatic pressure and said pulling force.

In accordance with one mode of performing the process according to the invention for processing a tubular billet into a pipe, the forward (downstream) end of the tubular billet is sealed and an internal hydrostatic pressure is built up inside the billet's bore which may be lower than or equal to the hydrostatic pressure inside the pressure chamber, whereby crumpling of the billet and pipe during extrusion and drawing is prevented. The pressurized liquid inside the billet's bore also serves for conserving the shape and the surface quality of the bore in the finished pipe. On this purpose, for thick-walled pipes the hydrostatic pressure inside the billet's axial bore may be substantially equal to that in the pressure chamber and this pressure is preferably maintained during extrusion and drawing until the pipe has completely left the extrusion die. In the manufacture of thin-walled pipes on the other hand, the internal hydrostatic pressure in a pipe currently located outside the hydroextrusion die must be lower than in the pressure chamber. The pressure reduction is so controlled that the hydrostatic pressure in the formed pipe emerging from the drawing operation does not exceed the yield point of the pipe forming metal.

In the manufacture of seamless tubular pipes in accordance with the above specified mode of operation, in the said first zone of deformation, both the internal and external hydrostatic pressures act on the pipe whereby the metal of the pipe wall is compressed. At the same time, the pipe is also exposed to a tensile force as a result of the pulling action to which the pipe is subjected at the delivery side of the drawing die or the last in a row of drawing dies, as the case may be. When the extruded intermediate product pipe leaving the terminal hydroextrusion die, passes across the intermediary empty region and enters the flanking drawing die, i.e. passes through the second zone of deformation, the pipe is subjected mainly to a tensile stress resulting from the pulling force applied for the performance of the drawing operation, in combination with a residual axially oriented hydrostatic pressure propagating from the pressure chamber and with a radial hydrostatic pressure exerted by the pressurized working liquid inside the pipe. In consequence of these combined stresses the deformation of the pipe after completion of the drawing operation may be as high as 90% or even more.

For the manufacture of pipes in accordance with the invention, at least one of the hydroextrusion and drawing dies may be assisted by a mandrel, which during operation is located inside the axial bore of the tubular billet and positioned in the bearing channel of said die. Any such mandrel may be exchangeable whereby the dies (in conjunction with the mandrels) may be adapted to the production of pipes with different wall thickness.

According to a combined mode of the process, in addition to providing the mandrels, a hydrostatic pressure not exceeding the pressure in the hydroextrusion chamber may be created in the axial bore of the tubular billet.

It is known in the art that plasticity and deformation of a body in a die is improved if carried out in a so-called fractional deformation mode. In the performance of the method according to the invention, it is possible to operate by the fractional deformation mode by shaping the bearing surfaces of the dies and/or of a mandrel with alternating sections of intensive deformation and so-called "rest" sections, i.e. sections where no deformation occurs. Unless otherwise required, such sections are so arranged that in the end result all parts of the billet and extruded intermediate product undergo the same processing. For example, the sections of intensive deformation and rest sections may be arranged in staggered rows or in alternating annular strips and grooves.

Where it is desired to obtain a final product having longitudinal sections with different mechanical properties, it is possible to carry out the process in accordance with the invention so as to yield uneven fractional deformation by providing longitudinal zones of the dies and/or mandrels with unequal fractional deformation patterns.

Where it is desired in accordance with the invention to process a long billet that exceeds the length of the pressure chamber, it is possible to first spool the billet inside the pressure chamber as known per se, and subsequently pay it out continuously through the hydroextrusion and drawing dies. Where in such a mode of operation the billet is tubular, the front (downstream) end thereof will as a rule be sealed, and the rear (upstream) end will be connected to means for supplying pressurized working liquid into the billet. During operation, the pressure inside the tubular billet and the chamber may be controlled as required.

If desired, the billets may be heated to a temperature of about 150° C.–600° C. by any one of known techniques (for example, by heating the billet itself or by heating the chamber) and the extruded intermediate product passing in the intermediary empty region is cooled down to a temperature of about 20° C.–50° C., for example, by spraying it with a lubrication fluid. Such a measure enables to increase the deformation by the hydroextrusion die or dies without increasing the working liquid pressure.

The invention also provides an apparatus for forming a metal billet into an elongated body of desired shape by a combined operation comprising hydrostatic extrusion and die drawing, which apparatus comprises a hydrostatic pressure chamber having a central axis, and upstream and downstream ends, a billet feeding opening at the upstream end and a terminal hydroextrusion die at the downstream end, characterized by comprising at least one drawing die downstream of, coaxial with and of smaller cross-sectional size than said terminal hydroextrusion die, which drawing die and hydroextrusion die are spaced from each other to form an intermediary empty region having a length L in axial direction, means being provided for the adjustment of the length L.

In one embodiment, the apparatus according to the invention comprises control means for continuously adjusting the hydroextrusion pressure and the pulling force during the processing cycle in accordance with requirements.

If desired, in an apparatus according to the invention designed for the production of pipes at least one of the dies (for example, a hydroextrusion die) may be assisted by a mandrel, having one or more frustoconical stages. The mandrel must be placed inside the axial bore of the billet and positioned in a bearing channel of said at least one die. Further if desired, said mandrel may be provided with an axial channel designed for controlled injection of working liquid into the extruded intermediate product emerging from the extrusion die, thereby to adjust the hydrostatic pressure inside the billet and extruded intermediate product in the course of operation, as may be required. The controlled injection may be accomplished, for example, by a return valve regulating the hydrostatic pressure in the axial bore.

In the above embodiment, it is possible to have sets of replaceable mandrels of different sizes for selected insertion into the dies, whereby it is possible to adjust the desired walled thickness of the product and in this way one and the same apparatus can be used for the manufacture of pipes with different wall thickness.

If desired, each mandrel of the set may be keyed on an axial rod which during operation is secured in the hydroextrusion chamber.

In a further embodiment of an apparatus according to the invention for the manufacture of pipes, the pressure inside an extruded tubular body may also be controlled by the provision of a throttle bar carrying on its downstream end a conical throttling block situated in the intermediary empty region of the apparatus and adapted to regulate the liquid pressure in the axial bore of the extruded intermediate product pipe before it is subjected to further deformation by drawing.

For further increasing the deformation in a single treatment cycle, the inner (bearing) surfaces of hydroextrusion and drawing dies in an apparatus according to the invention may be provided with grooves arranged in an axially staggered pattern with alternating deformation and rest sections. Such grooves may for example, extend in axial direction and if desired, may form a pattern that is not axisymmetric (i.e. circumferentially staggered so as to form alternating deformation and rest periods), whereby the product body is formed with longitudinal sections having different properties. Alternatively, said grooves may also be circumferential and suitably spaced from each other in axial direction.

In order to reduce the shot effect and to decrease the amount of the required working liquid when processing billets with relatively small cross-dimensions, said pressure chamber may be provided with an intermediate tubular casing installed between the billet and inner walls of said chamber and having orifices ensuring free access of the working liquid to the billet.

In accordance with one embodiment of an apparatus according to the invention designed for the processing of long billets, the pressure chamber comprises a spool on which the billet is wound in a first phase as known per se, and in a second phase the billet is paid off continuously into the hydroextrusion and drawing dies. Where the long billet is tubular, means are provided in the apparatus for feeding pressurized working fluid into the inner bore of the tubular billet, said billet being sealed at its downstream end.

In a further embodiment of an apparatus according to the invention, it comprises means for heating the billet in the pressure chamber, and means are provided in the intermediary empty region for cooling the extrusion intermediate product passing therethrough.

By yet another embodiment of an apparatus according to the invention the said intermediary empty region is in form of an expansion chamber designed to collect any working fluid forced out of the terminal hydroextrusion die at the end of an operational cycle, means being provided for recycling the collected working fluid back to the pressure chamber.

In accordance with this embodiment, the expansion chamber comprises two constituent shells capable of being linked together either directly or with the interposition of spacer members, whereby the said length L is adjustable.

BRIEF DESCRIPTION OF THE DRAWINGS

For better understanding, the invention will now be described, by way of example only, with reference to the annexed drawings in which.

DETAILED DESCRIPTION OF PREFERRED EMBODIMENTS

Figure 1:
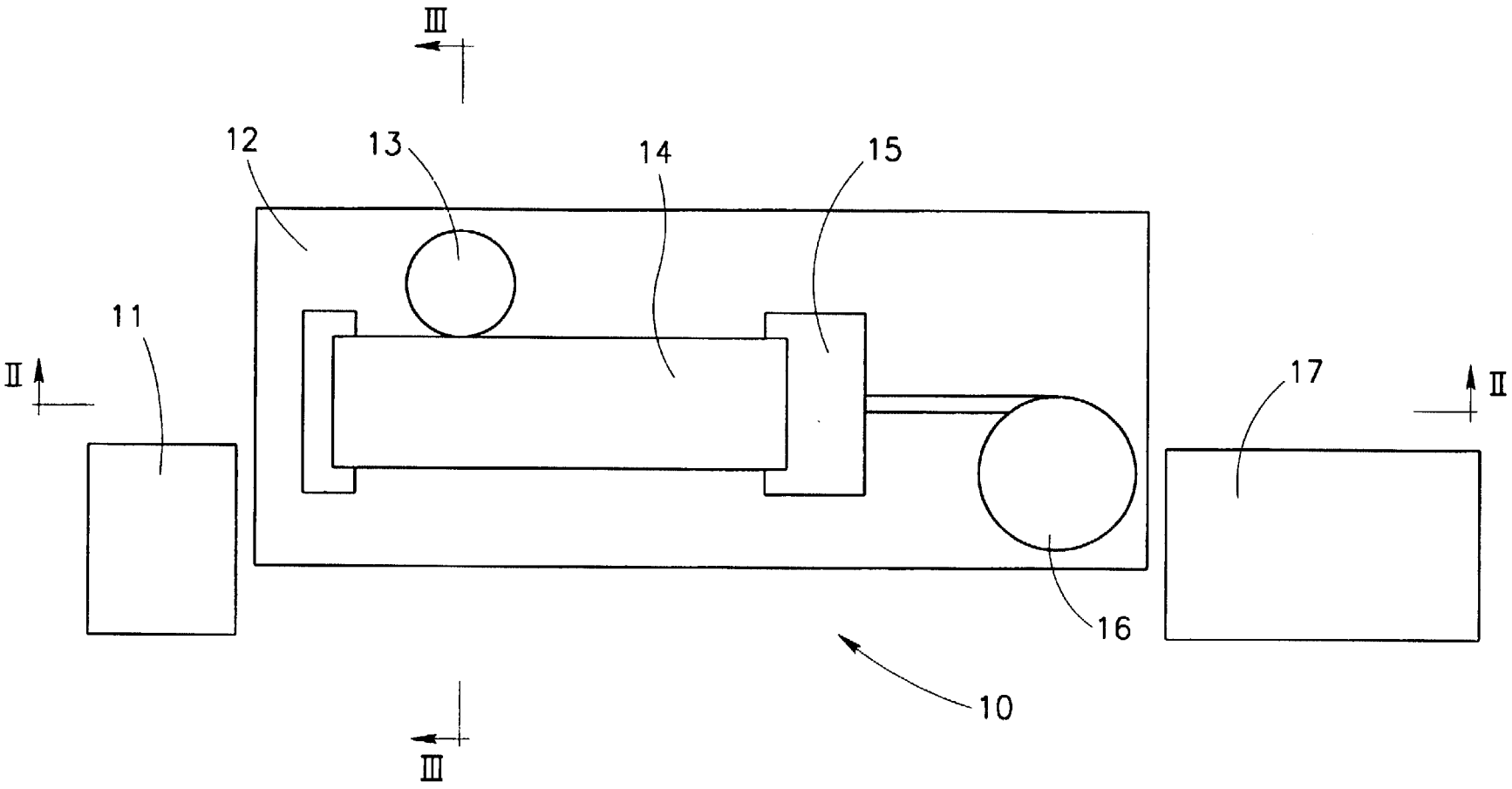
FIG. 1 is a schematic top view of an apparatus according to the invention.

FIG. 1 schematically illustrates a top view of an apparatus 10 comprising the following main units:

a table 11 for receiving billets and transferring them one by one to the processing line, a bedplate 12, a pressurized fluid supply unit 13, a hydrostatic pressure chamber (a hydroextrusion chamber) 14; a deformation unit 15, a pulling device 16, and a table 17 for receiving the finished products (elongated bodies, such as pipes, rods, wire).

Tables 11 and 17 have designs known from the prior art, and therefore are not considered in detail. The specific design implementations of tables 1 and 7 depend on the dimensions of processed billets and those of the finished products. Bed 12 serves for assembling the units and auxiliary equipment.

Unit 13 is intended for supplying the pressurized working liquid into the pressure chamber 14, for pushing air bubbles out of said container and controllably creating a working pressure value in the liquid which is necessary for billet deformation. The deformation unit 15 serves for effecting a combined process of drawing and hydroextrusion of a billet in one processing cycle and will be described in detail with reference to FIGS. 2, 4 and 6.

Figure 2:
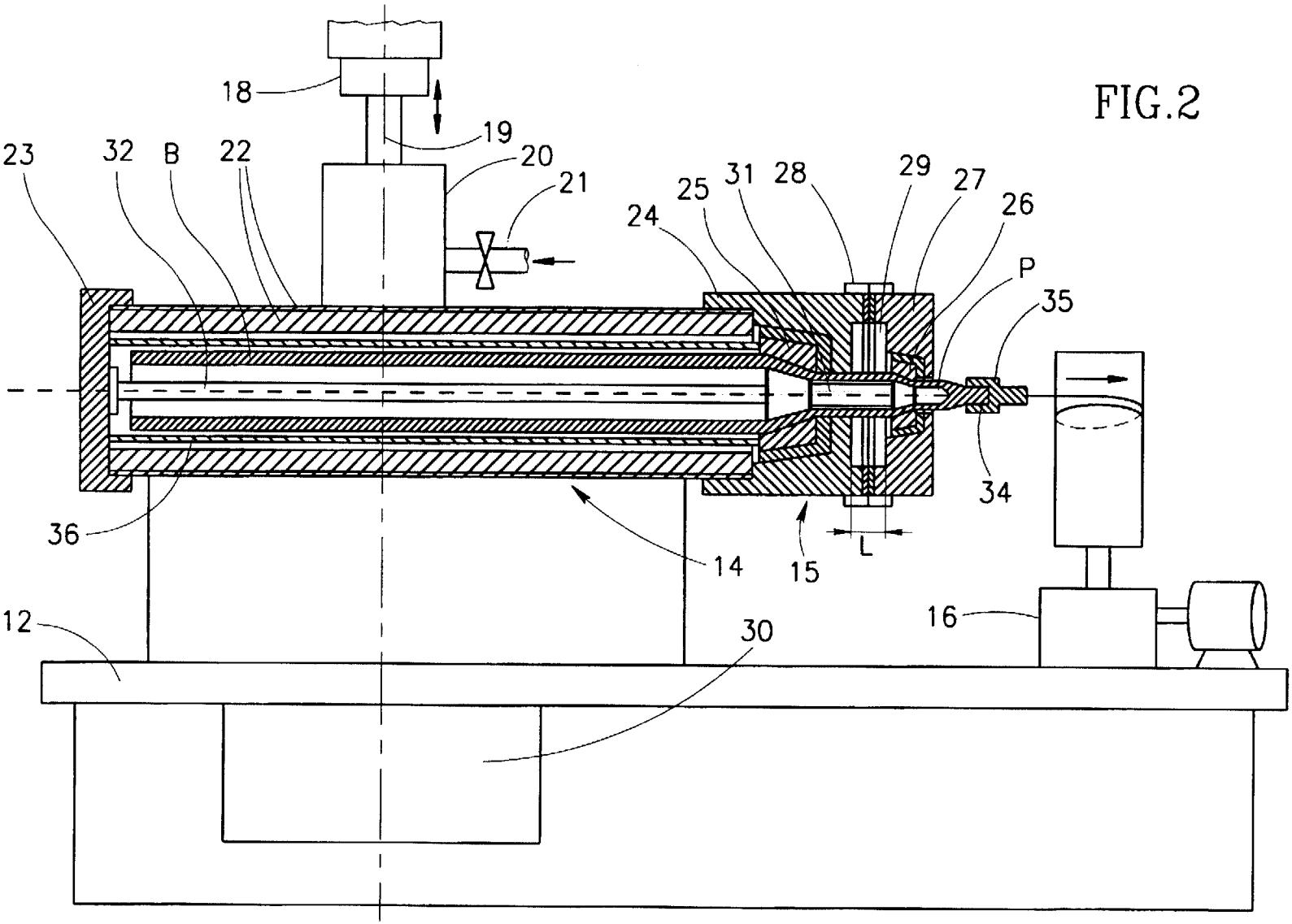
FIG. 2 is a cross-sectional view taken along lines II—II of FIG. 1.
Figure 3:
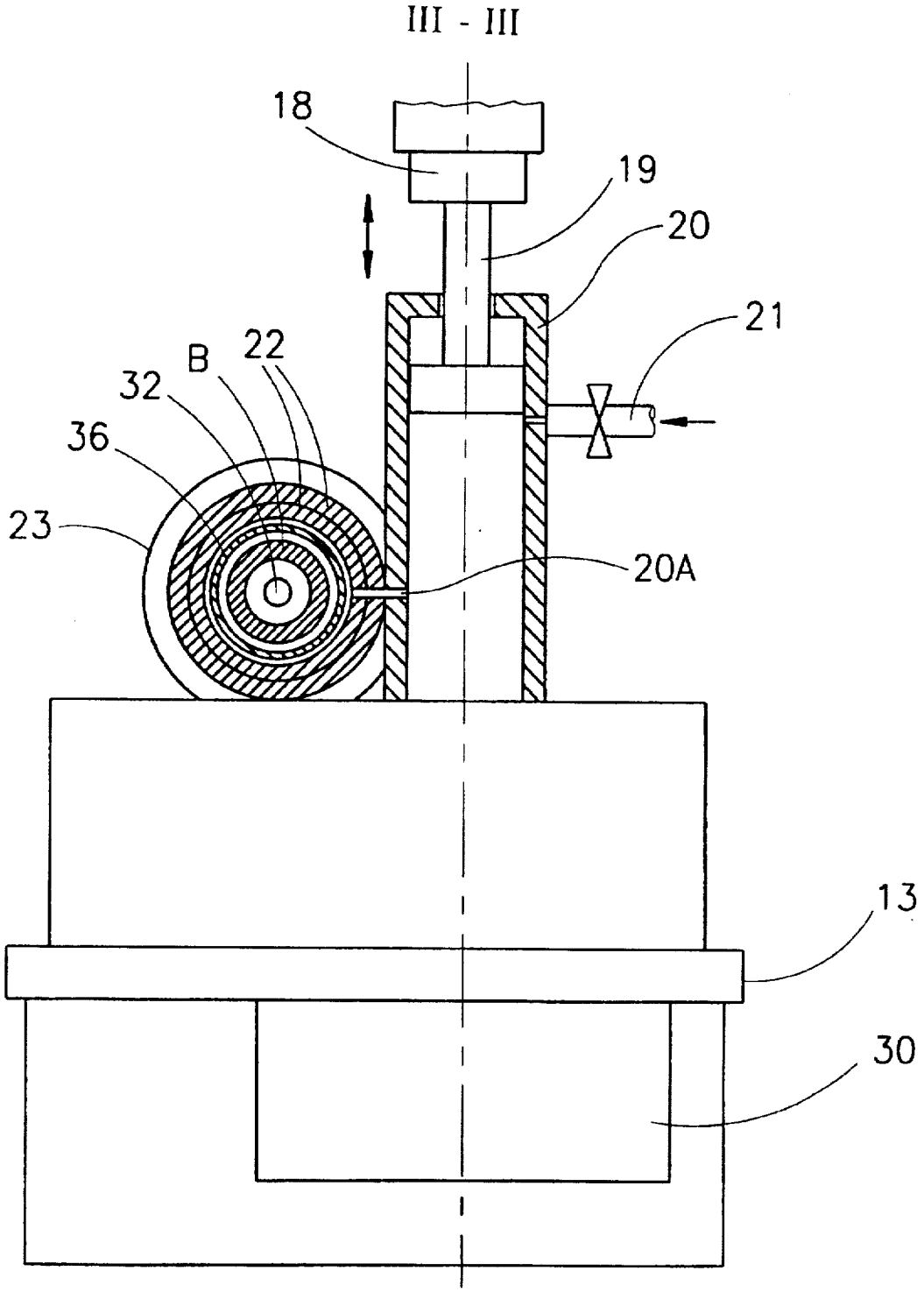
FIG. 3 is a cross-sectional view taken along lines III—III of FIG. 1.

As shown in FIGS. 2 and 3, unit 13 consists of a pressure source 18 which can be a hydraulic press or a pump actuating a piston 19 for creating a preset working value of the liquid pressure inside a cylinder 20, which liquid is further transferred under the working pressure to the chamber 14. The working liquid is supplied to the cylinder 20 via a recycling system 21. The hydrostatic pressure chamber 14 is intended for the deformation of the billet B (see FIG. 2) by the pressure of liquid. In this particular example the tubular billet B is shown; however, solid billets also may be processed in the illustrated apparatus 10, for the manufacture of wires and rods. Pressure chamber 14 (See FIGS. 2 and 3) comprises a casing 22 (single- or multi-layered, depending on the liquid pressure), a detachable front cover 23 and rear cover 24. The working liquid is supplied to the chamber 14 from the cylinder 20 through an orifice 20A.

Figure 4:
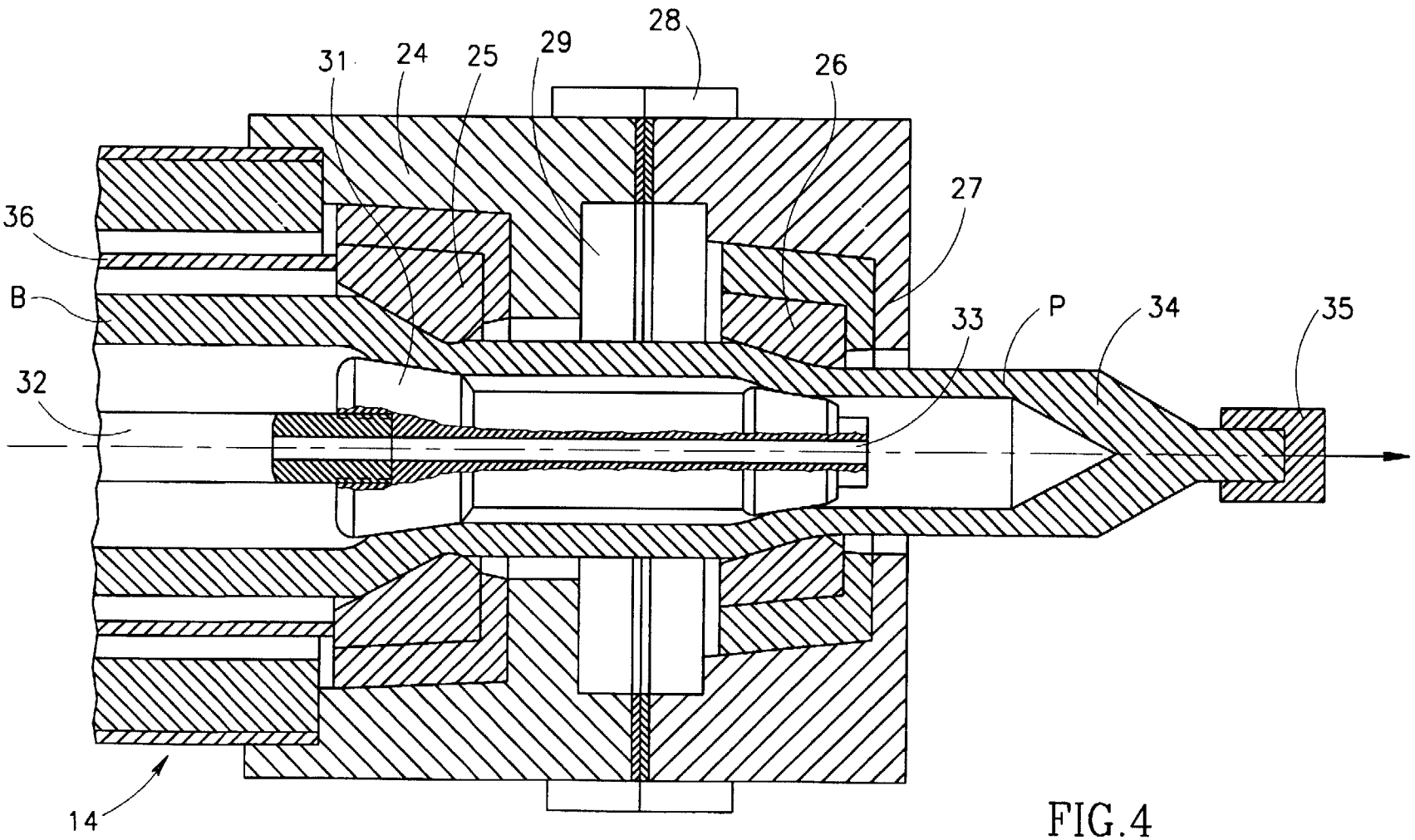
FIG. 4 is a fragmentary cross-sectional view showing the downstream portion of the apparatus of FIGS. 1 to 3, drawn to a larger scale.
Figure 6:
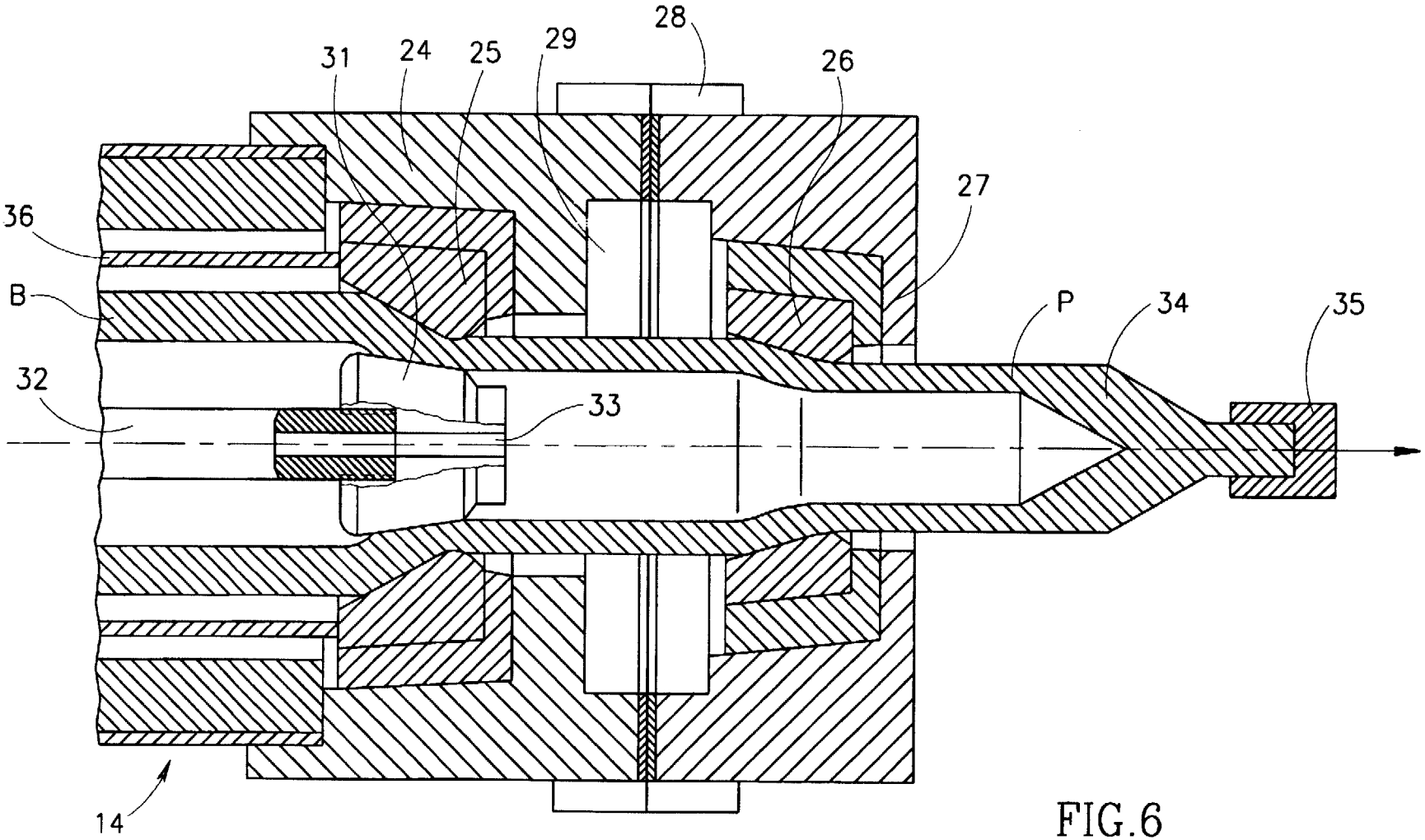
FIG. 6 is a cross-sectional view of the downstream portion of another embodiment of an apparatus according to the invention.

Deformation unit 15, which is shown enlarged in FIGS. 4 and 6, comprises: a hydroextrusion die 25 fixed in the cover 24, and a drawing die 26 mounted in a drawplate 27, through which two dies the billet B is caused to pass from the left to the right during the processing, owing to the combined action of the hydroextrusion and pulling forces. The extrusion die 25 and the drawing die 26 are spaced from one another at a distance L which may be adjusted prior to each processing cycle according to the properties and dimensions of the billet B. The distance L is selected as the minimal span at which, during the processing, a portion of the billet currently located at an intermediary empty region between the hydroextrusion die 25 and the drawing die 26 will not loose its elastic stability. For adjusting the distance L the cover 24 and the drawplate 27 are connected by a movable detachable joint 28 (of a known design), and form together an expansion chamber 29 which is empty at the beginning of any processing cycle, and at the end of the processing cycle receives the working liquid forced from the hydroextrusion chamber 14 through the die 25. The chamber 29 is provided with means (not shown in the drawing) for quick discharging the working liquid to a tray 30.

The sequential treatment of the billet B in the extrusion die 25 and in the drawing die 26 separated from one another by the expansion chamber 29, assures the elimination of the billet shot after extrusion without any additional devices, because when the rear end of the billet B is forced out from the extrusion die 25, the pressure chamber 14 will immediately loose its tightness, and the hydrostatic pressure will be automatically cut off, while the rear end of the billet B will be retained in the drawing die 26.

In a case when the billet B is tubular, as is shown in FIGS. 2, 3, 4, 6 the deformation unit may also comprise a mandrel 31 fixed on an axial rod 32 secured in the chamber. A system of channels 33 (only one is shown in FIG. 4) may be arranged in the rod 32 and in the mandrel 31, for supplying the working fluid to the forward portion of the billet which has passed the hydroextrusion die 25, and further to the finished pipe P which has passed the drawing die 26. The channels in the mandrel 31 may be provided with return valves (not shown) which ensure controlled supply of the liquid into the forward portion of the billet for creating the inner pressure at a level which would ensure maintaining the deformation scheme with a so called "fluid mandrel" while drawing, and hence a favorable deformation arrangement and the required form of the inner pipe channel. Drawing unit is intended for clamping the preformed front end 34 of the billet by grip 35 and carrying out the drawing process through the drawing die 26 by means of a pulling device 16.

In the treatment of billets with small diameters, an intermediate tubular casing 36 is used (See FIGS. 2, 3, 4, 6, 9) which allows to decrease the required volume of the working liquid and, consequently, to reduce the "shot" effect after the billet extrusion stage. The intermediate tubular casing 36 is installed coaxially with the inner walls of the chamber 14 and the outer billet dimensions, and it has orifices for supplying the working liquid into the space between the casing 36 and the billet B (not shown on the drawings), wherein the total cross-section of the orifices is greater than that of the working fluid supply orifice 20A.

Figure 5:
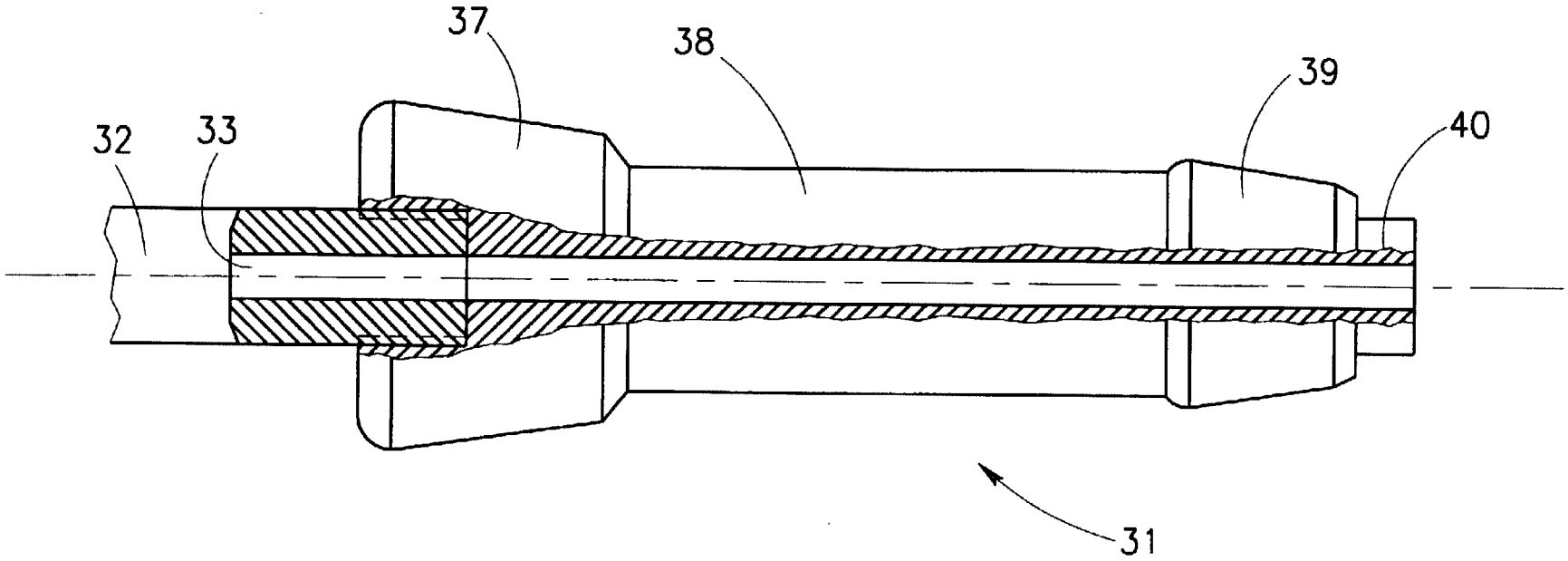
FIG. 5 is an elevation, partly in section of a nozzle forming insert in an apparatus according to FIGS. 1 to 4, drawn to a larger scale.
Figure 7:
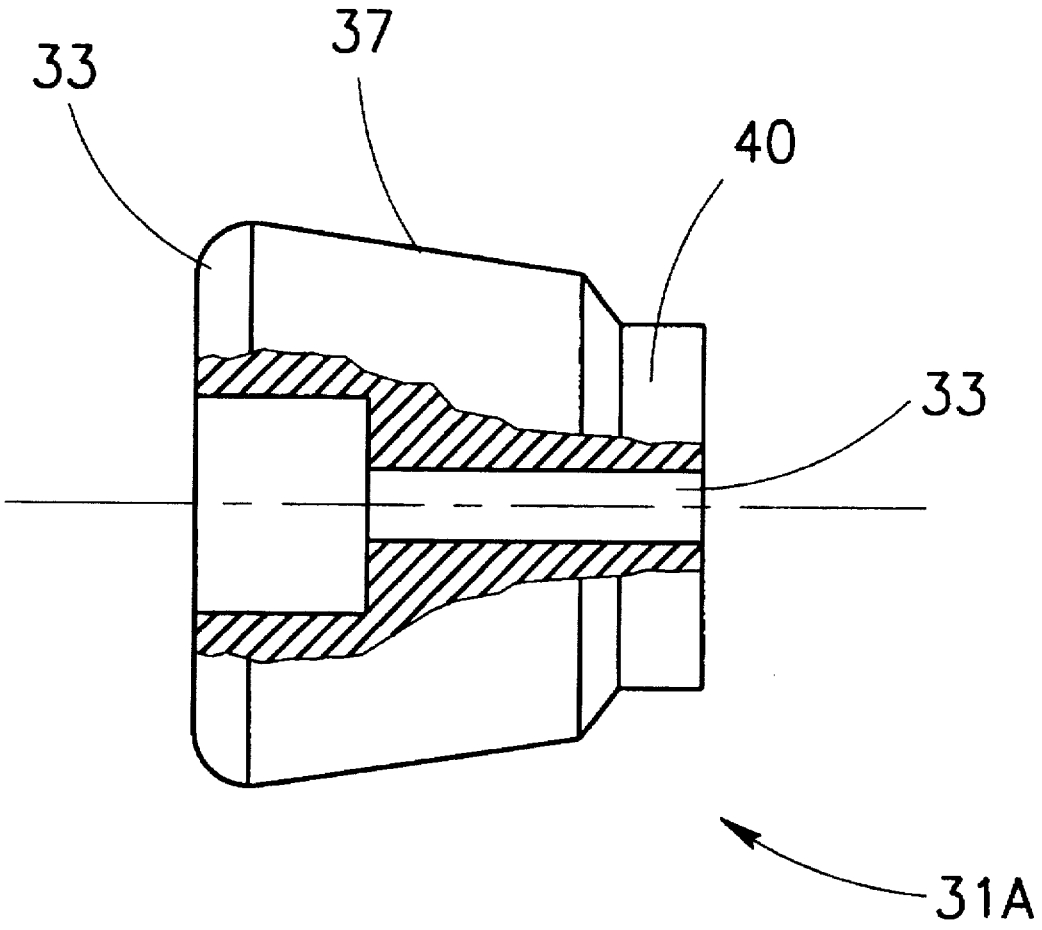
FIG. 7 is an elevation, partly in section of an insert used for the formation of a hydroextrusion nozzle in the embodiment of FIG. 6.

FIGS. 5 and 7 show variations of mandrels adapted for double and single billet wall deformation, respectively. The mandrel 31 shown in FIG. 5 consists of a securing zone in the form of a rod 32, a first bearing zone (a so called first stage of pipe wall deformation) 37, a transition zone 38, a second bearing zone (the second stage of pipe wall deformation) 39, and a mandrel shank 40. The mandrel 31A in FIG. 7 comprises a single stage 37 of pipe wall deformation. The number of wall deformation stages (37 and 39) is determined by the accepted technology and can be varied from none to several stages. The transition zone 38 may be rigid or elastic. A return valve (not shown) may be installed in the channel 33 for the pressure control in the pipe.

Figure 9:
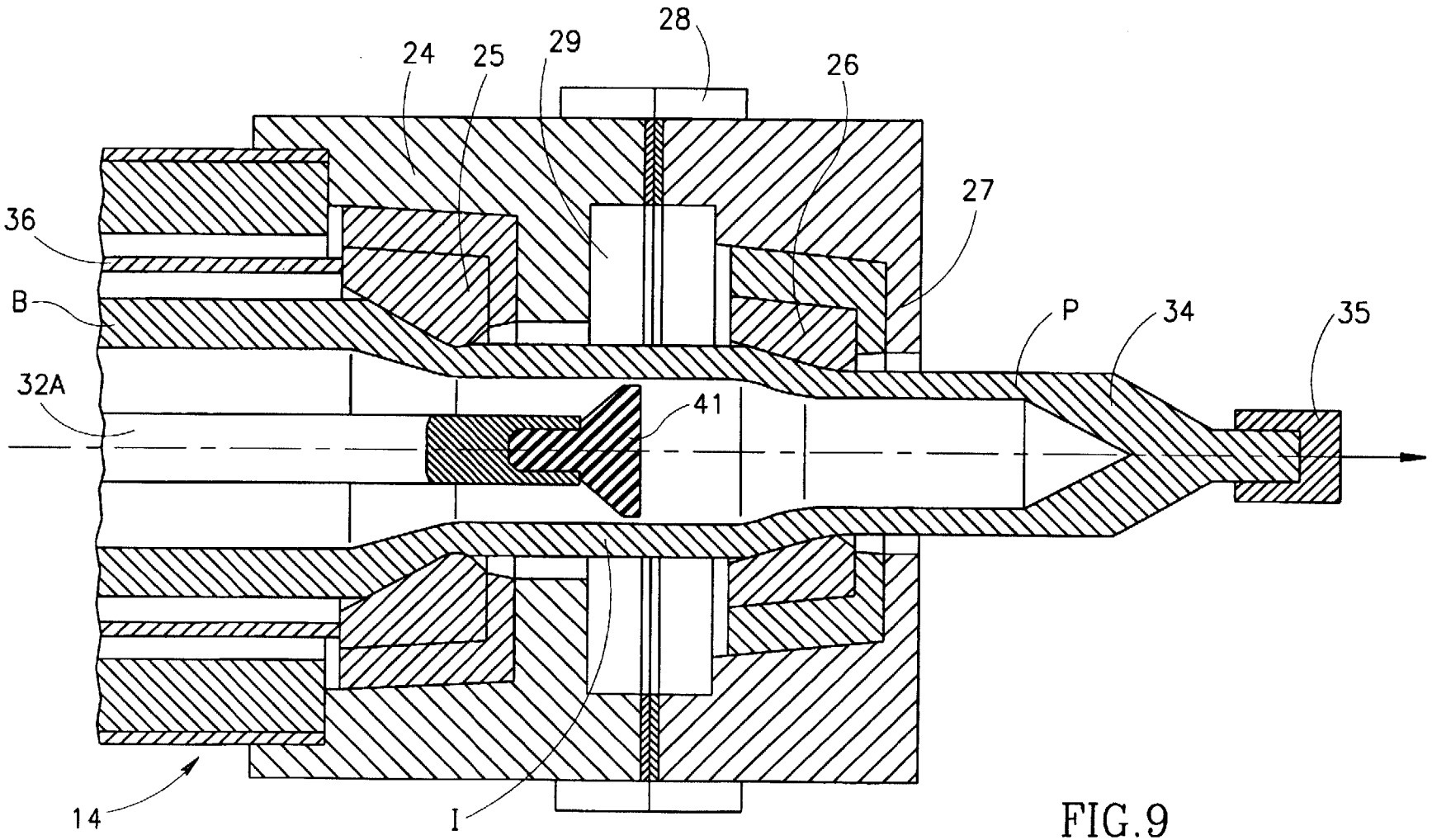
FIG. 9 is a cross-sectional view of the downstream portion of yet another embodiment of an apparatus according to the invention.

Attention will now be directed to FIG. 9. The pipe may be deformed without a rigid mandrel, and a rod 32A serves as a throttle bar regulating pressure of the working liquid in an intermediate product pipe I, and in the finished pipe P. The length of the rod 32A is selected in such a way that its end protrudes at least 1 mm out of the limits of the billet deformation zone in the extrusion die 25, in the direction of the finished pipe motion. In this case, the rod 32A can be made without any inner channel, and the control of the amount of working liquid which is supplied to the pipe is carried out by selecting the diameter of the rod (in a particular case it may be 0.5 mm less than the inner pipe diameter after passing the extrusion die. The rod 32A may also be provided with an elastic element 41 in the form of a reversed cone mounted on the end of the rod and serving as a return valve. The cone is directed against the pipe motion, and the projection area of its base on a plane perpendicular to the direction of motion of the pipe is changeable depending on difference of pressures acting at two sides of the base of the cone 41. The elastic element 41 thus serves for varying the clearance value and controlling the liquid supply and the hydrostatic pressure inside the intermediate pipe product I and pipe P. This pressure should not exceed the yield point of the billet forming metal, which is of special importance in thin-wall pipe production, as these pipes should be protected from ruptures.

Figure 8B:
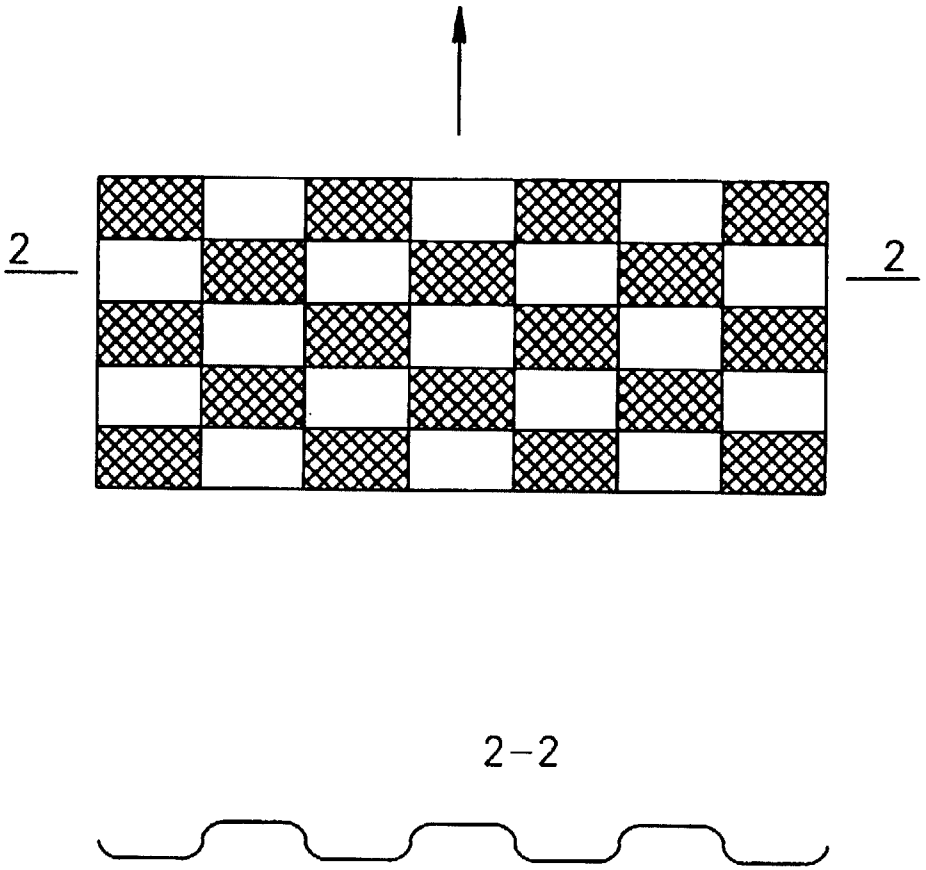
FIGS. 8A and 8B show examples of patterns of alternating deformation and rest areas provided on the innermost surfaces of dies in an apparatus according to the invention for achieving fractional deformation.
Figure 8A:
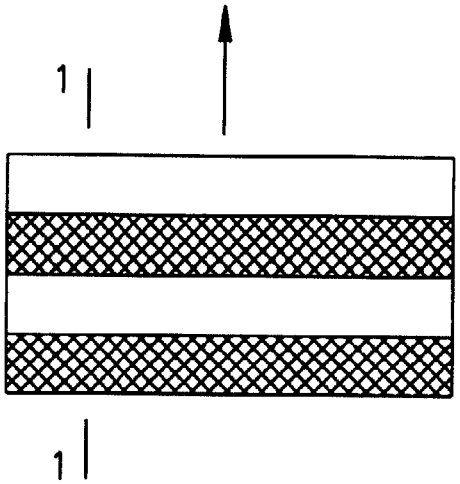

Returning now to FIGS. 8*a* and 8*b*, there are shown variants of metal "rest" sections placement on the surface of the deforming tools, such as inner bearing surfaces of the dies and/or outer bearing zones of the mandrels. FIG. 8*a* illustrates a portion of a pattern, where these "rest" sections (grooves) are placed as concentric strips normal to the billet motion which is shown by an arrow; a cross-sectional view of the grooves is shown herein below. In an analogous way, FIG. 8*b* illustrates the rest sections placed in staggered rows. The slope of the grooves is so selected, that the total number of rest sections and their parameters for each billet section during a single deforming cycle are approximately equal, which enables to achieve uniform properties in the finished pipe metal. Conversely, if different mechanical properties of the metal are required in the finished product, the number and dimensions of the rest sections as well as the distance between them may be changed according to calculations and/or experiments.

Figure 10:
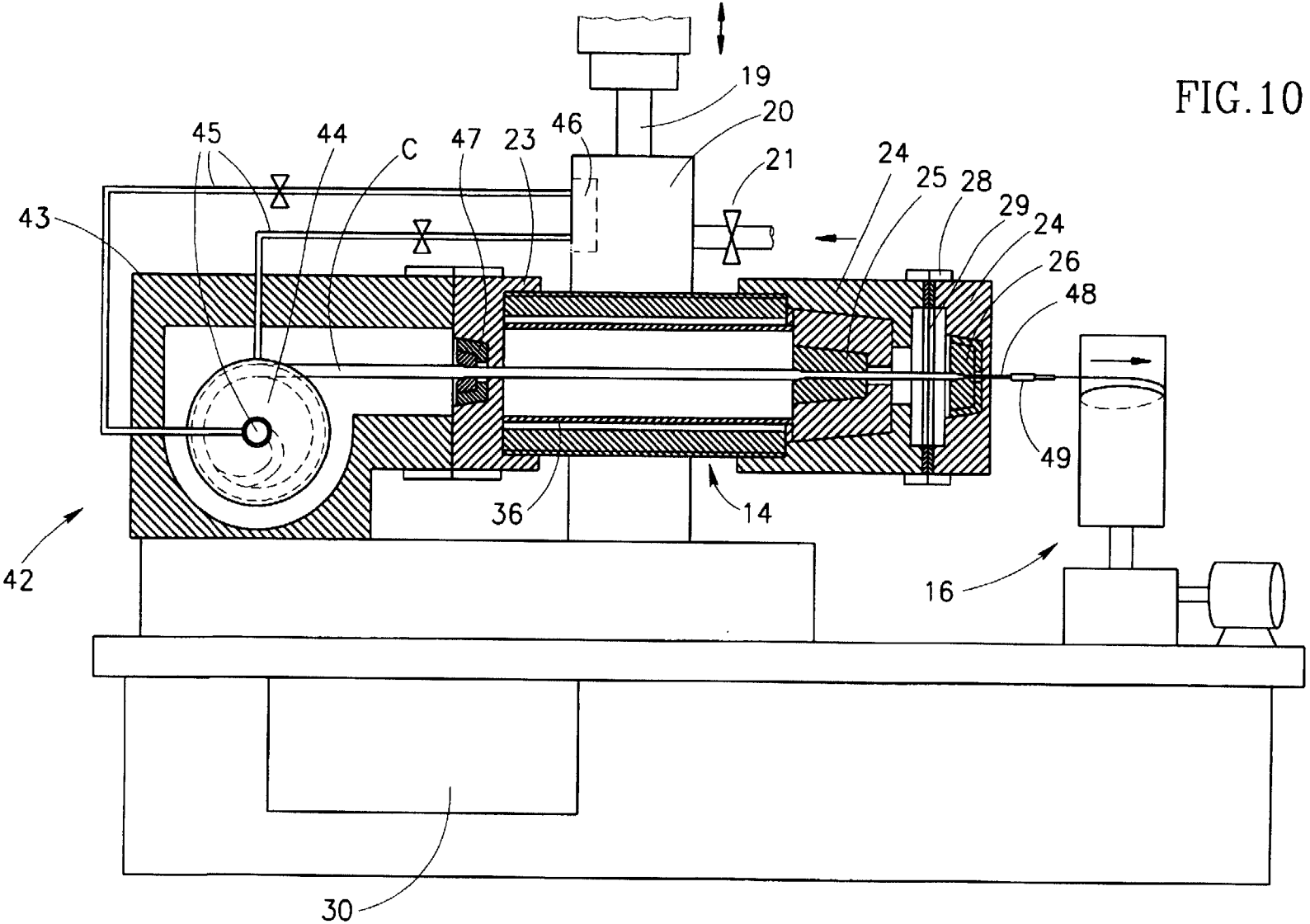
FIG. 10 is a cross-sectional view of yet another embodiment of an apparatus according to the invention adapted for processing long tubular billets.

FIG. 10 shows an embodiment 42 of the proposed device intended to provide for processing of long billets, or manufacture of capillary long pipes wound on coils. In the apparatus 42 the pressure chamber 14 is provided with a pressure compartment 43. The compartment 43 is placed on the front cover (23) side of the chamber 14. A spool 44 is placed in the compartment 43 with a long tubular billet C wound on the spool. One end of the billet C is tightly connected to an axial channel of the spool being in fluid communication with and forming part of a conduit 45. The conduit 45 is connected to a port of the working fluid supply via a pressure control system 46. An additional inlet hydroextrusion die 47 is installed in the front cover 23. In this device, the billet is subjected twice to hydroextrusion (firstly in the compartment 43 through the inlet die 47, and secondly in the chamber 14 through the hydroextrusion die 25), and then to drawing. A floating (movable) mandrel may be placed inside the tubular billet (not shown). The pressure in the compartment 43, in the chamber 14 and inside the pipe billet C is controlled by systems 46 and 20, thus providing the optimum deformation conditions for the billet.

The process may be carried out with heating the billet in the pressure chamber 14 and cooling in the relief chamber 29, and the apparatus may be equipped with devices for billet or chamber heating, and for billet cooling, if necessary.

In accordance with the proposed method the apparatus operates as follows:

Variant 1 (FIGS. 1, 2, 4, 6, 9)

Billets B, which have undergone preliminary surface treatment according to the conventional scheme and the forming/sealing of their ends on equipment which is not included in the described equipment, are supplied onto table 11. Then they are transferred one by one to the processing stages. For this purpose, rear cover 23 is opened, and the billet is installed on the drawing line, with preformed end 34 being passed through hydroextrusion die 24 and drawing die 25 (if several sequential dies are used, then the billet end is passed through all the dies). Billet end 34 is clamped by grip 35 and pulled by pulling device 16 until a tight contact between billet B and extrusion die 24 is achieved. The pressure chamber 14 is then hermetically sealed by cover 23 which may be provided, if necessary, with mandrel 31, bar 32, and tubular casing 36. The bar and the mandrel are inserted into the billet B and fixed on cover 23.

At this point, the working liquid is supplied through orifice 20A from system 21 and cylinder 20 into chamber 14, and the pressure value is brought to the working level (for example, 5 to 20 thousand bars), at which point the billet hydroextrusion and drawing begin. At the initial moment, the pulling force is exerted only on the extruded part of the billet, thus assisting the hydroextrusion in overcoming the friction of rest (the peak load); subsequently, after the extrusion process has begun, the billet is moved towards the drawing die 25, and the combined deformation process of hydroextrusion and drawing begins, where the whole drawing force, or the major part thereof, is used for performing the process of drawing billet B into pipe P. The distribution of the drawing force depends on the selected combination of the hydroextrusion pressure, the pulling force and the drawing speed, thus providing the tension, compression or other stress state between the deformation zones, which are necessary for defining the conditions of metal deformation. This scheme may be maintained by a control system (not shown in the drawings) which continuously measures the parameters of the pipe exiting from the drawing die and provides corresponding continuous adjustment of the initially set parameters of the process. In practice, the control system may be a computerized control system adapted to adjust the hydroextrusion pressure and the pulling force during the processing cycle in accordance with initial parameters of the billet, parameters of the required final product and using the continuously measured speed of the final product exiting from the device.

When the rear end of billet B exits from extrusion die 24, the shot is prevented owing to braking of this end in the drawing die and abrupt releasing the liquid pressure in the chamber 14. The fluid splashed from the chamber and the rear end of the billet into the relief chamber 29 is discharged into tray 30, and then to the purification and cycling system. Unit 13 is switched off. After the drawing process is completed, pulling device 16 of the drawing unit is switched off. The grip 35 releases the end 34 of the finished pipe P. The finished pipe P is then transferred to table 17, from which it goes on to further treatment according to a conventional arrangement, on equipment which is not included in the described apparatus.

The processing cycle is subsequently repeated.

Variant 2 ( FIG. 10).

A spool 44 with a coiled tubular billet C is installed inside compartment 43 through a window closed by a cover (not shown). One end of the tubular billet C is left open or (in the case of great length, or small inner diameter of the billet) connected via the axial channel of the spool 44 to a port of system 46 for supplying the working fluid and controlling its pressure. The other (preformed) end 48 of tubular billet C is installed on the drawing line by passing it through extrusion dies 47, 25 and drawing die 26. The billet end 48 is then clamped by grip 49 and pulled by pulling device 16 until a tight contact between billet C and extrusion dies 47 and 25 is achieved (arrangements are possible where tight contact with only one of these dies is required). After this, the compartment cover is closed, and the pumping of the working fluid into compartment 43 and the chamber 14 begins, according to a preset program, by means of systems 20 and 46, followed by the start of the drawing and hydroextrusion process in a manner analogous to that of Variant 1. When the process is completed and all systems are switched off, the compartment 43 is opened, spool 44 (which is now free of the billet, since at the end of the process it is forced away from the spool) is extracted, and the process is repeated.

The above-described process arrangement and equipment construction provide for a wide range of possibilities in selecting the process arrangement from the standpoint of deformation regimes, pressing or pulling forces between the deformation zones, controlling the pipe material properties. In addition, intermediate pulling mechanisms (such as those in the U.S. Pat. No. 3,841,129) are not required in the use of the proposed equipment and production process, since the scheme provides the billet deformation in the direction of the finished pipe motion.

We claim:

1. A method of forming a metal billet into an elongated product body of desired cross-sectional shape and dimension by a combination of die drawing and hydroextrusion from a pressure chamber having a central axis, holding a pressurized working liquid and being fitted with at least a terminal hydroextrusion die, characterized by placing at least one drawing die of smaller cross-sectional size than said terminal hydroextrusion die in coaxial alignment with the latter at a distance L downstream therefrom whereby said terminal hydroextrusion die and at least one drawing die form a pair of dies flanking an intermediary empty region;

adjusting said distance L to fit the metal and size of the elongated product body such that any stretch of an extruded body passing through the intermediary empty region retains its elastic stability;

continuously extruding the billet through said terminal hydroextrusion die to form an extruded intermediate product;

continuously passing said extruded intermediate product across said intermediary empty region into said at least one drawing die; and continuously pulling an elongated product body out of said at least one drawing die;

whereby said elongated product body is obtained with desired degrees of precision and surface quality in one operational cycle.

2. The method of claim 1, comprising providing an expansion chamber at said intermediary empty region, said expansion chamber being designed to collect any working liquid forced out of the terminal hydroextrusion die at the end of an operational cycle, and the so collected working liquid is recycled to the pressure chamber.

3. The method of claim 1, wherein the hydroextrusion operation is performed by one single, terminal hydroextrusion die.

4. The method of claim 1, wherein the hydroextrusion operation is performed by a series of coaxially aligned hydroextrusion dies mounted in a wall of the hydroextrusion chamber and having gradually diminishing bearing cross-sectional areas in which series said terminal hydroextrusion die is the one distal from the pressure chamber.

5. The method of claim 1, wherein the drawing operation involves the use of one single drawing die.

6. The method of claim 1, wherein the drawing operation is performed by a coaxially aligned row of drawing dies with gradually diminishing bearing cross-sectional areas.

7. The method according to claim 1, comprising adjusting said distance L from about 2 to about 6 D, where D is a cross-dimension of the delivery end of the terminal hydroextrusion die.

8. The method according to claim 1, applied for the manufacture of thick-walled pipes in which the ratio between the outer diameter and the walled thickness is less than 5, comprising adjusting the distance L to be essentially not less than 6 D, where D is a cross-dimension of the delivery end of the terminal hydroextrusion die.

9. The method according to claim 1, applied to the manufacture of wires, rods and thin-walled pipes in which the ratio between the outer diameter and the walled thickness is more than 5, wherein the minimum distance L is about 2 D, where D is a cross-dimension of the delivery end of the terminal hydroextrusion die.

10. The method according to claim 1, comprising selecting a suitable combination of process parameters for creating a desired stress state regime in said extruded intermediate product, which parameters are the hydrostatic pressure inside the pressure chamber, the pulling force and the velocity at which the elongated product emerges from the drawing operation.

11. The method according to claim 10, wherein a compression stress is created in the axial direction of said extruded intermediate product moving across said intermediary empty region.

12. The method according to claim 11, wherein an additional force created in the intermediate product due to compression does not exceed about 0.4 of the pulling force.

13. The method according to claim 10, wherein a tensile stress is created in the axial direction of said extruded intermediate product passing through the intermediary empty region.

14. The method according to claim 10, comprising continuously measuring the velocity at which the elongated product body emerges from the drawing operation, and continuously adjusting said hydrostatic pressure and pulling force, whereby the selected stress state regime in the extruded intermediate product is continuously maintained.

15. The method according to claim 1, applied to the manufacture of a pipe from a tubular billet having an axial bore.

16. The method according to claim 15, wherein the downstream end of the tubular billet is sealed and an internal hydrostatic pressure is built up inside the billet's axial bore, which pressure does not exceed the hydrostatic pressure inside the pressure chamber.

17. The method according to claim 16, applied to the manufacture of thick-walled pipes, wherein the internal hydrostatic pressure inside the billet's axial bore is substantially equal to that in the pressure chamber.

18. The method according to claim 16, applied to the manufacture of thin-walled pipes, wherein the internal hydrostatic pressure inside the axial bore of the intermediate product and the hydrostatic pressure in the product body emerging from the drawing operation is lower than in the pressure chamber.

19. The method according to claim 15, wherein a mandrel is positioned in a bearing channel of at least one of said hydroextrusion and drawing dies; said mandrel being placed inside the axial bore of the intermediate product.

20. The method according to claim 1, carried out in the fractional deformation mode by shaping at least one inner bearing surfaces of said hydroextrusion and drawing dies with alternating sections of intensive deformation and sections where no deformation occurs.

21. The method according to claim 20, wherein said alternating sections are evenly distributed over said at least one inner bearing surface, whereby all parts of the billet are processed uniformly.

22. The method according to claim 20, wherein said alternating sections are unevenly distributed over said at least one inner bearing surface so as to form thereon alternating longitudinal zones with different fractional deformation patterns, whereby the billet is processed in a non-uniform fashion.

23. The method according to claim 1, applied to the processing of a long billet exceeding the length of the pressure chamber, comprising first spooling the billet inside the pressure chamber and continuously paying it out through the hydroextrusion and drawing dies during the operational cycle.

24. The method according to claim 1, wherein the billet is heated to a temperature of about 150° C.–600° C., and said extruded intermediate product passing in the intermediary empty region is cooled down to a temperature of about 20° C.–50° C.

25. An apparatus for forming a metal billet into an elongated body of desired shape by a combined operation comprising hydrostatic extrusion and die drawing, which apparatus comprises a hydrostatic pressure chamber having a central axis, and upstream and downstream ends, a billet feeding opening at the upstream end and a terminal hydroextrusion die at the downstream end, the apparatus being characterized by comprising at least one drawing die downstream of, coaxial with and of smaller cross-sectional size than said terminal hydroextrusion die, which drawing die and hydroextrusion die are spaced from each other to form an intermediary empty region having a length L in axial direction, means being provided for the adjustment of the length L.

26. The apparatus according to claim 25, comprising control means for continuously adjusting the hydroextrusion pressure and the pulling force during operation.

27. The apparatus according to claim 25 designed for the production of a pipe from tubular billet having an axial bore.

28. The apparatus according to claim 27, wherein at least one of said hydroextrusion and drawing dies is provided by a mandrel placed inside the axial bore of the billet and positioned in a bearing channel of said at least one die.

29. The apparatus according to claim 28, wherein the mandrel is located in the bearing channel of said terminal hydroextrusion die, which mandrel is provided with an axial channel designed for controlled injection of working liquid into an extruded intermediate product emerging from the extrusion die, whereby the hydrostatic pressure inside the billet and said extruded intermediate product is adjusted in the course of operation.

30. The apparatus according to claim 28, comprising a set of replaceable mandrels of different sizes for selected insertion into at least one of said hydroextrusion and drawing dies.

31. The apparatus according to claim 30, wherein each mandrel of said set is capable of being keyed on an axial rod, said rod being securable in the hydroextrusion chamber during operation.

32. The apparatus according to claim 27, comprising a throttling bar for controlling the hydrostatic pressure inside the extruded intermediate tubular body, which throttling bar carries on its downstream end a conical throttling block.

33. The apparatus according to claim 25, wherein the inner bearing surface of at least one of the hydroextrusion and drawing dies is provided with grooves arranged in an axially staggered pattern of alternating deformation and rest sections.

34. The apparatus according to claim 33, wherein said grooves are circumferential and spaced from each other in axial direction.

35. The apparatus according to claim 33, wherein said grooves extend in axial direction and form a circumferentially staggered pattern of alternating deformation and rest periods.

36. The apparatus according to claim 25, wherein said pressure chamber is provided with an intermediate tubular casing insertable between the billet and inner walls of said chamber and having orifices ensuring free access of the working liquid to the billet.

37. The apparatus according to claim 25 designed for the processing of long billets, wherein the pressure chamber comprises a spool on which the billet is wound prior to the forming operation.

38. The apparatus according to claim 37, designed for the processing of long tubular billets, comprising means for controlled feeding pressurized working liquid into the axial bore of the tubular billet wound on the spool.

39. The apparatus according to claim 25, comprising means for heating the billet in the pressure chamber, and means for cooling the extruded intermediate product passing through said intermediary empty region.

40. The apparatus according to claim 25, wherein said intermediary empty region is in form of an expansion chamber designed to collect any working liquid forced out of the terminal hydroextrusion die at the end of an operational cycle, means being provided for recycling any collected working fluid to the pressure chamber.

41. The apparatus according to claim 40, wherein the expansion chamber comprises two constituent shells capable of being linked together either directly or with the interposition of spacer members, whereby said length L is adjustable.

* * * * *